US005556094A

United States Patent [19]

Shiledar Baxi

[11] Patent Number: 5,556,094

[45] Date of Patent: Sep. 17, 1996

[54] HOCKEY-TYPE GAME

[76] Inventor: Hari R. Shiledar Baxi, 8 Churchill Sq., Schenectady, N.Y. 12309

[21] Appl. No.: 494,034

[22] Filed: Jun. 26, 1995

[51] Int. Cl.[6] ..... A63F 7/06

[52] U.S. Cl. ..... 273/108.5; 273/57.2; 273/126 R

[58] Field of Search ..... 273/126 R, 126 A, 273/128 R, 128 A, 128 CS, 108, 118 R, 118 F, 57.2, 85 R, 85 A, 85 B, 85 C, 85 D

[56] References Cited

U.S. PATENT DOCUMENTS

| | | | |
|---|---|---|---|
| D. 247,127 | 1/1978 | Kauka . | |
| 3,391,933 | 7/1968 | Cooper | 273/126 R |
| 3,825,264 | 7/1974 | Dockum | 273/126 R |
| 3,913,918 | 10/1975 | Trachtman | 273/126 R |
| 4,300,766 | 11/1981 | Haynes . | |
| 4,311,309 | 1/1982 | Bradley et al. . | |
| 4,834,371 | 5/1989 | Hay et al. | 273/126 A X |
| 4,872,679 | 10/1989 | Bohaski et al. . | |
| 5,046,734 | 9/1991 | Laine . | |
| 5,074,556 | 12/1991 | Loeppky et al. | 273/126 R X |
| 5,372,364 | 12/1994 | Arroyo | 273/118 R X |
| 5,417,421 | 5/1995 | Bagley | 273/126 R X |

*Primary Examiner*—Raleigh W. Chiu

*Attorney, Agent, or Firm*—David L. Baker; Rhodes & Ascolillo

[57] ABSTRACT

A table sized hockey-type game has a frame attached to the base. The frame defines a playing area bearing indicia designed to resemble a hockey rink. There are goal and goal tending placed on each end of the playing area. There are four removable legs attached to the bottom of the frame. The game has a moveable game piece and a number of sticks. The length of the sticks may be adjusted as the player desires. Play is commenced by placing the game piece in play and attempting to bat it into the goal The game may be played by four to six players, and ends when one team reaches a predetermined number of goals.

7 Claims, 3 Drawing Sheets

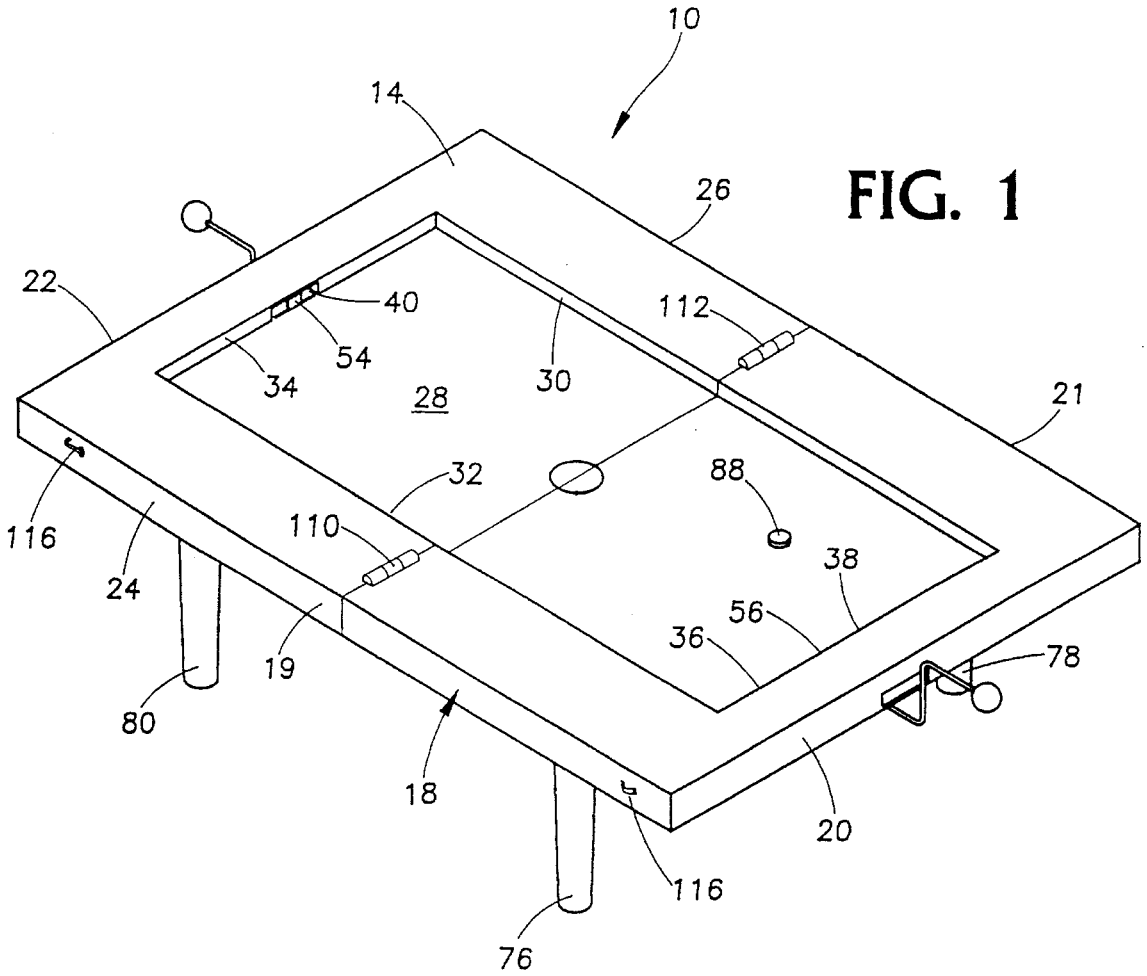
FIG. 1
FIG. 2
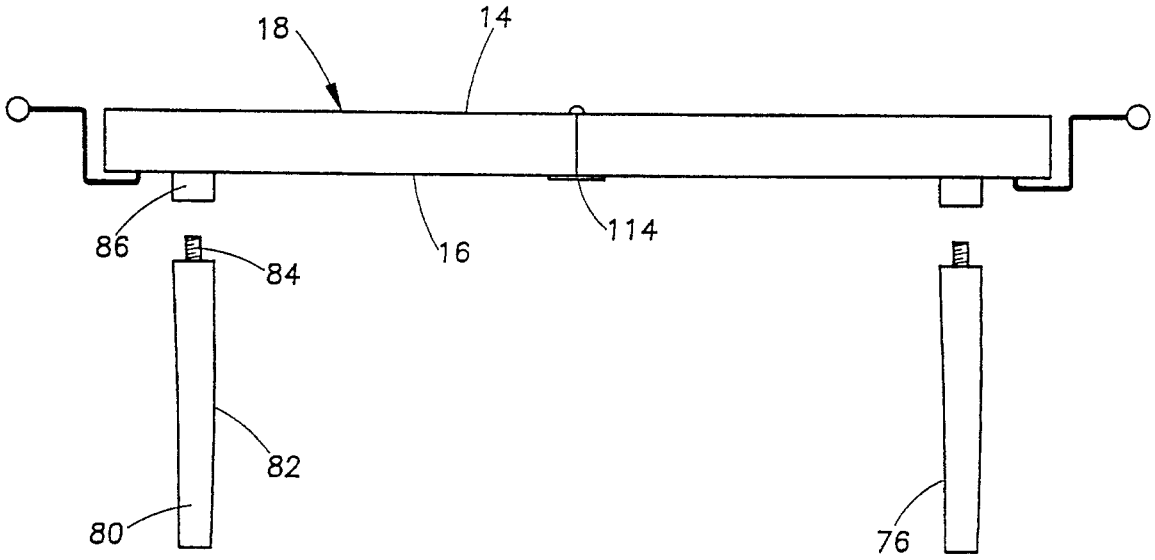

HOCKEY-TYPE GAME

BACKGROUND OF THE INVENTION

1. Field of the Invention

This invention relates generally to hockey-type games. Specifically, it relates to a pool table sized hockey-type that may be played either indoors or outdoors.

It is well known that many people enjoy watching various professional sporting events. One of the more popular events is hockey. Unfortunately, the game requires a specially prepared frozen surface of considerable size and a certain amount of natural skill and coordination in order to play it properly. In addition, hockey can be a rough game that involves considerable jostling, checking and falling. Since many people lack either the playing area or the skill, they must avail themselves of other opportunities to play hockey.

One of these other opportunities is a table top game. Generally, these devices consist of small boards with a number of player figures disposed on the boards. The player figures are controlled by control rods disposed on the sides and ends of the game.

Although enjoyable, these games do not simulate hockey particularly well. Instead of striking a puck with a stick, the player translates or rotates a control rod which in turn causes a player figure strike the game piece. The motor skills and coordination required to successfully play these table top games are generally dissimilar from those needed for a true game of hockey.

There exists a need for a game that allows players to use motor skills similar to actual hockey while simultaneously releasing players from the need for a specially prepared frozen surface as well as the need to endure repeated contact with the other players and the ice. There currently exists no device which serves these purposes.

2. Description of the Related Art

A thorough search of the related art reveals several patents in the field of table sized games. For example, U.S. Pat. No. 5,046,734 issued Sep. 10, 1991 to Laine for a Table Hockey Game describes an apparatus with a playing surface, goals and a plurality of movable toy hockey players. The hockey players are moved using shafts.

U.S. Pat. No. 4,872,679 issued Oct. 10, 1989 to Bohaski et al for a Combination Table Top Football and Hockey Game consisting of a hinged board with a hockey rink depicted on one side and a football field disposed on the other side. Bohaski includes removable nets and a scoreboard.

U.S. Pat. No. 4,311,309 issued Jan. 19, 1982 to Bradley et al for a Table Top Hockey Game. This invention closely resembles Laine's invention in that there are a plurality of control rods that move figures.

U.S. Pat. No. 4,311,309 issued Nov. 17, 1981 to Haynes for a Hockey-Type Table Game Apparatus. The invention consists of a table game with a strung playing surface. A game piece moves across the strung surface when hit by a bat.

U.S. Pat. No. Des. 247,127 issued Jan. 31, 1978 to Kavka for a Combined Hockey and Pool Game.

None of these inventions, taken singly or in combination, anticipate or make obvious the present invention.

SUMMARY OF THE INVENTION

In one aspect, the present invention consists of a hockey-type game with a planar rectangular frame, a top surface of the planar rectangular frame and a bottom surface of the planar rectangular frame. The top surface of the frame is constructed of material with a low coefficient of friction. There is a plurality of support legs attached to the bottom surface of the frame. The frame is rectangular and has opposed outer minor walls and opposed outer major walls. The overall dimensions of the invention approximate a pool table.

There is a playing area in the frame. The playing area preferably measures approximate twelve feet by six feet, although other dimensions may be used. The playing area features opposed major side walls and opposed minor side walls with a goal means disposed on each of the minor side walls. There is goal tending means proximate each goal means.

The invention teaches a movable playing piece disposed within the playing area. The game piece is formed in the shape of a right cylinder. There are a plurality of sticks for used by players to strike the movable playing piece. Each stick resembles a small hockey stick. There is telescoping portion, a gripping portion and a striking portion. The telescoping portion is slidably movable between a plurality of positions. The telescoping portion is lockable in either the first or the second position. The striking portion is disposed at an angle of approximately 150 degrees from the telescoping portion. The striking portion has two opposed vertical planar surfaces.

It is therefore a principal object of the invention to provide a table sized hockey-type game.

It is a second object of the invention to provide a hockey-type game that is portable.

It is a third object of the invention to provide a hockey-type game that is usable indoors or outdoors.

It is a fourth object of the invention to provide a hockey-type game that develops motor skills similar to those used in an actual hockey game.

It is a fifth object of the invention to provide a hockey-type game that develops the above mentioned motor skills without requiring the player to risk bodily contact with other players and the playing surface.

It is a final object of the invention that the invention be durable and easily manufactured.

These and other objects of the invention that are not mentioned above will become more obvious by referring to the Drawings and claims that are annexed to and form a part of this disclosure.

BRIEF DESCRIPTION OF THE DRAWINGS

FIG. 1 is a perspective view of a hockey-type game according to the present invention.

FIG. 2 is an exploded left side view of the hockey-type game according to the present invention.

DETAILED DESCRIPTION OF THE PREFERRED EMBODIMENT

Figure 3:
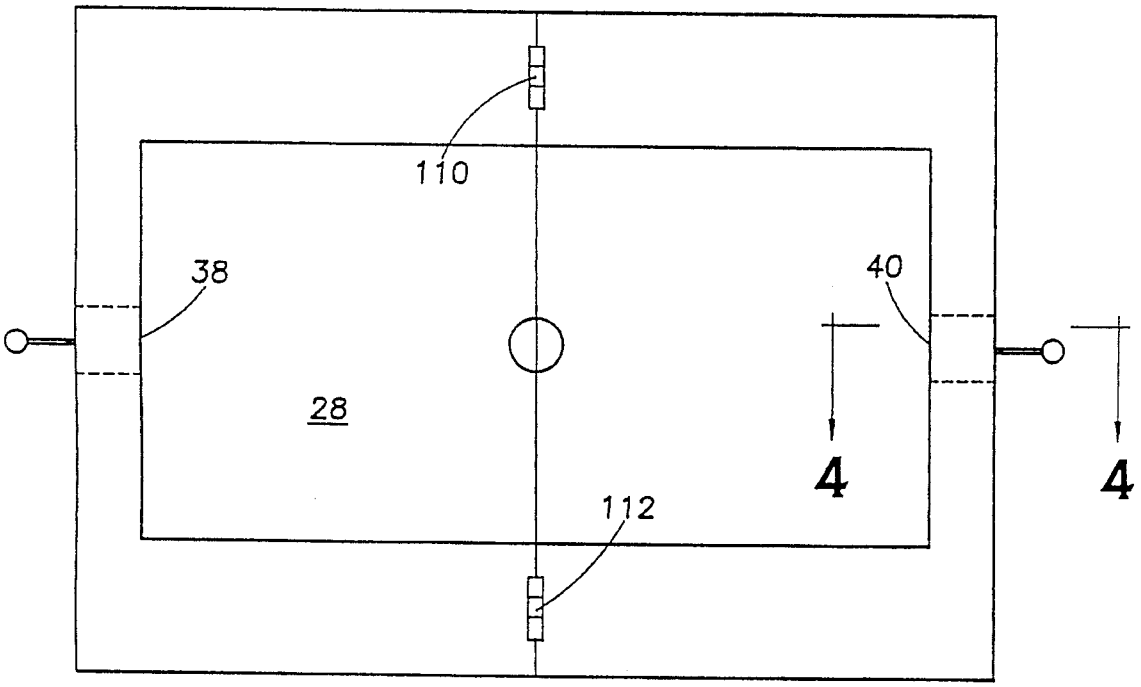
FIG. 3 is a top plan view of the hockey type game according to the present invention.

Referring now to FIGS. 1–3, a hockey-type game is shown generally at 10. The game has a planar rectangular frame 18, a top surface 14 of the planar rectangular frame and a bottom surface 16 of the planar rectangular frame.

The frame 18 consists of opposed outer minor walls 20, 22 and opposed outer major walls 24, 26. The frame is divided into first portion 19 and second portion 21 and is connected in a manner described later in this disclosure. Frame 18 is preferably constructed of wood, wood byproduct or plastic materials, although it is well within the scope of the invention to substitute alternative materials. Playing area 28 is a 12 foot by 6 foot rectangular area with opposed major side walls 30, 32 and opposed minor side walls 34, 36. There are indicia designed to resemble a hockey rink disposed on Playing are 28. Playing area 28 is preferably constructed of plastic or resin coated particle board, although it may be constructed of any structurally sound material that has a low coefficient of friction. There is a goal means 38, 40 disposed on each of the minor sides walls 34, 36, as well as a goal tending means 54, 56 placed proximate each goal means 38, 40. Because each goal means 38, 40 and each goal tending means 54, 56 are substantially identical, only one is described below.

Figure 4:
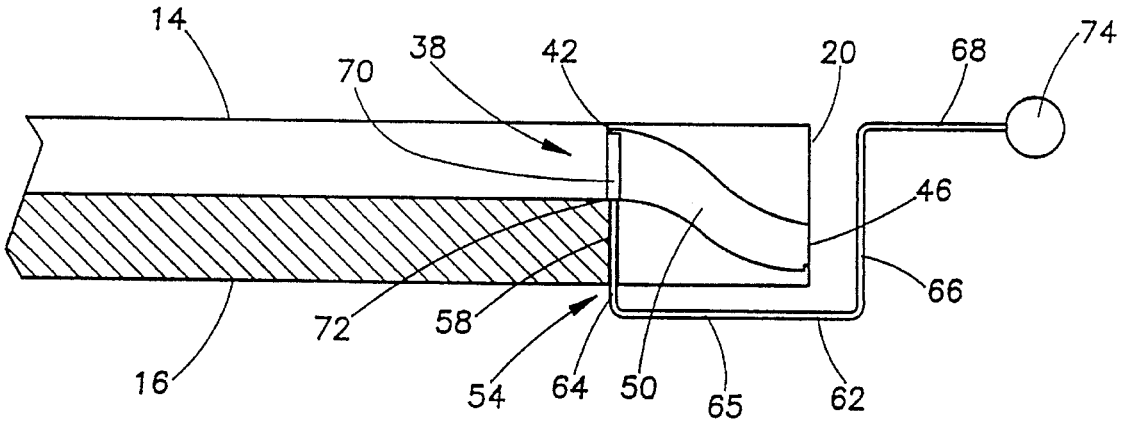
FIG. 4 is a detail view of the goal means and goal tending means taken along Line 4—4 of FIG. 3.

Referring now to FIG. 4, there is a goal means 38 consisting of first apertures 42 disposed in the center of minor side walls 34 and second aperture 46 disposed in the center of outer minor wall 20. Passage 50 communicates between the first aperture 42 and the second aperture 46.

Goal tending means 54 is placed proximate goal means 38. Goal tending means 54 consists of a slot 58 disposed proximate first aperture 42. The slot 58 communicates with bottom surface 16 of the planar rectangular frame 18. There is a bent wire member 62 with a first vertical portion 64. Bent wire 62 is preferably constructed of steel, although any resilient metal may be used.

The bent wire 62 has a first vertical portion 64 that slidably engages slot 58. Bent wire 62 also has a first horizontal portion 65 that extends beyond the nearest of the opposed outer minor walls of the frame so as to provide clearance for second vertical portion 66. Second horizontal portion 68 of the bent wire 62 projects away from the outer minor wall.

An upstanding block member 70 is fixedly attached to an end of the first vertical portion 64. Bottom surface 72 of upstanding block member 70 slidingly engages top surface 14. Gripping member 74 is fixedly attached to an end of the second horizontal member 68. A user may grasp gripping member 74 and selectively move it left and right. This causes a corresponding translation of bent wire 62 and upstanding block member 70. The translation of bent wire 62 and upstanding block member 70 is limited by the dimensions of slot 58.

Referring once again to FIGS. 1–3, there are four support legs that are threadingly attached to the bottom surface 16 of the frame 18. FIG. 1 shows three of the legs 76, 78, 80. The fourth leg is hidden from view, but is identical to the three shown. For this reason only one leg is described. There is a leg portion 82 and a threaded rod portion 84 that engages a thread receiving portion 86. Thread receiving portion 86 is fixedly attached to the bottom surface 16. Each thread receiving portion is of sufficient height that first horizontal portion 65 will not contact the ground when the legs are removed and the invention rests on the thread receiving portions. In the preferred embodiment of the invention the legs measure approximately two feet in height.

Figure 6:
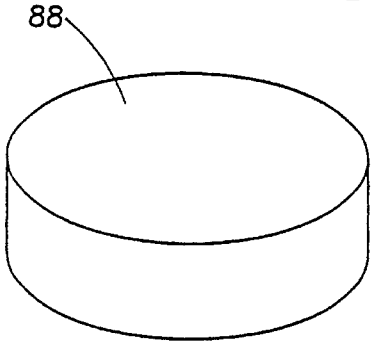
FIG. 6 is a perspective view of the moveable game piece used in the hockey-type game.

Referring now to FIG. 6, the movable playing piece 88 that is placed within the playing area is shown. Moveable game playing piece 88 is a right cylinder that is designed to resemble a hockey puck, although the size may be varied if necessary. Movable playing piece 88 is preferably constructed of a polymeric material that has a sufficiently low coefficient of friction that it will slide easily within playing area 28.

Figure 5:
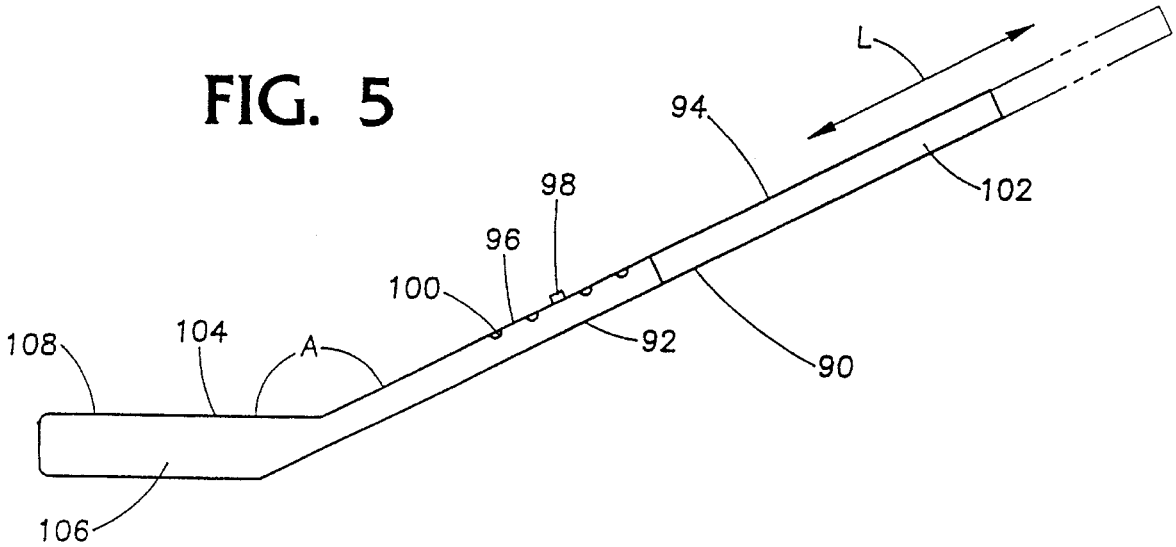
FIG. 5 is a left side elevational view of the stick used in the hockey-type game.

Referring now to FIG. 5, the stick 90 that is used to strike movable playing piece 88 is shown. The stick has a telescoping portion 92 that allows a user to vary the length of the stick by sliding a first portion 94 into a second portion 96, as shown by arrow L, then locking first portion 94 into position using spring biased button 98 that engages plurality of apertures 100. Stick 90 has gripping portion 102 attached to first portion 94, and a striking portion 104 attached to second portion 96. Striking portion 104 is fixedly attached at an angle A that measures approximately 150 degrees. Striking portion 104 has two opposed vertical planar surfaces 106, 108.

Figure 7:
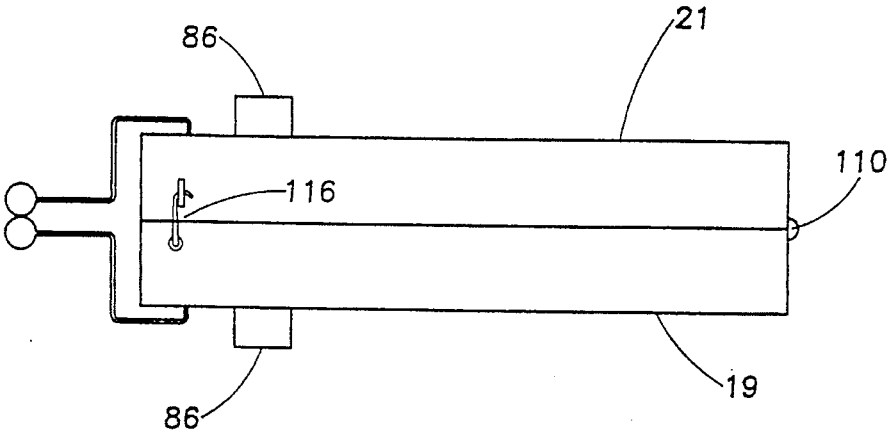
FIG. 7 is a left side view of the hockey-type game according to the present invention with the invention shown in the closed position.

Referring now to FIGS. 1, 2 and 7, the invention is shown folded for easy storage. The frame is folded using hinges 110, 112 disposed on frame 18. In order to secure the frame in the open position, there are hook and eye fasteners 114 on the bottom surface 18. There are hook and eye fasteners 116 on the opposed major side walls that secure the frame in the closed position.

The game may be played using either four or six players. Two persons operate the goal tending means. The remaining players position themselves around the opposed outer major walls. The movable game piece is placed in play by dropping it into the playing area. The players may then attempt to score a goal by causing the game piece to enter the opposing team's goal means. Once the game piece enters the goal means via the first aperture, it may be removed from the second aperture. The rules of the game conform to the rules of hockey with two exceptions. First, there is no icing penalty. Second, instead of using a penalty box to punish players, a team committing a penalty awards one point to the other team. Game play continues according to these rules until one team scores a predetermined number of goals. That team is declared the winner.

The game may be played with or without the legs. The length of the stick may be adjusted to accommodate the differences. It is also within the scope of the invention to provide that the height of the second vertical portion of the bent wire be adjustable as well.

The foregoing disclosure relates only to a preferred embodiment of the invention. Various substitutions and equivalents may be substituted without departing from the letter and spirit of the invention.

I claim:

1. A hockey game comprising:

a) a planar rectangular frame; a top surface on the planar rectangular frame; a bottom surface on the planar rectangular frame;

b) the frame comprising:

opposed outer minor walls connected to the top and bottom surfaces; and opposed outer major walls connected to the top and bottom surfaces;

c) a playing area defined in the frame comprising:

opposed major side walls ; and opposed minor side walls connected to the opposed major side walls;

d) a goal member disposed on each of the minor sides walls comprising:

an first aperture disposed in the center of each minor side wall;

an second aperture disposed in the center of outer minor wall; and a passage communicating between the first aperture and the second aperture;

e) a goal tending member disposed proximate each goal member comprising:

a slot disposed proximate each of the first apertures, the slot communicating with the bottom surface of the planar rectangular frame;

a bent wire member comprising:

a first vertical portion of the bent wire member slidably engaging each slot;

a first horizontal portion of the bent wire, the first horizontal portion extending beyond the nearest of the opposed outer minor walls of the frame;

a second vertical portion of the bent wire member; and a second horizontal member of the bent wire member;

an upstanding block member fixedly attached to an end of the first vertical portion;

a gripping member fixedly attached to an end of the second horizontal member; and whereby the bent wire may be selectively positioned within the slot;

f) a plurality of support legs;

g) a movable playing piece disposed within the playing area; and h) a plurality of sticks for striking the movable playing piece.

2. The hockey game described in claim 1, wherein the playing area further comprises:

a) a planar rectangular surface having a low coefficient of friction; and b) indicia disposed on the planar rectangular surface.

3. The hockey game described in claim 1, wherein the moveable playing piece further comprises a right cylinder having a low coefficient of friction.

4. The hockey game described in claim 1, wherein each of the plurality of sticks further comprise:

a) a telescoping portion;

b) a gripping portion attached to a first end of the telescoping portion;

c) a striking portion attached to a second end of the telescoping portion;

d) the striking portion disposed at an angle of approximately 150 degrees from the telescoping portion; and e) the striking portion comprising two opposed vertical planar surfaces.

5. The hockey game described in claim 1, wherein the planar rectangular frame further comprises:

a) a first portion;

b) a second portion;

c) the first portion and the second portion hingedly movable between an open position and a closed position;

d) a means of locking the first portion and the second portion in the open position; and e) a means of locking the first portion and the second portion in the closed position.

6. The hockey game described in claim 1, wherein the plurality of support legs number four.

7. The hockey game described in claim 1, wherein the plurality of support legs are removably and threadingly connected to the bottom surface of the frame.

* * * * *